US005417178A

United States Patent [19]

Harrelson, II

[11] Patent Number: 5,417,178

[45] Date of Patent: May 23, 1995

[54] BOAT MOUNTED ANTENNA CONTROLLER SYSTEM

[75] Inventor: Clyde W. Harrelson, II, Wilmington, N.C.

[73] Assignee: Marine Motion, Inc., High Point, N.C.

[21] Appl. No.: 159,452

[22] Filed: Nov. 24, 1993

Related U.S. Application Data

[63] Continuation-in-part of Ser. No. 987,632, Dec. 9, 1992, abandoned.

[51] Int. Cl.[6] ..... H01Q 1/34

[52] U.S. Cl. ..... 114/343; 114/270; 343/709

[58] Field of Search ..... 114/270, 343; 212/192, 212/193, 194; 343/713, 714, 715, 880, 881, 882, 893, 709

[56] References Cited

U.S. PATENT DOCUMENTS

| | | | |
|---|---|---|---|
| 3,224,003 | 12/1965 | Hummel | 343/709 |
| 4,055,845 | 10/1977 | Ladrick | 343/882 |
| 4,993,346 | 2/1991 | Rupp | 114/255 |
| 5,177,493 | 1/1993 | Kawamura | 343/897 |

FOREIGN PATENT DOCUMENTS

| | | | |
|---|---|---|---|
| 1088086 | 3/1955 | France | 343/882 |
| 619703 | 3/1949 | United Kingdom | 343/714 |

*Primary Examiner*—Michael S. Huppert
*Assistant Examiner*—Thomas J. Brahan
*Attorney, Agent, or Firm*—Olive & Olive

[57] ABSTRACT

The invention provides a controller for moving a boat mounted pole device, such as a marine antenna, from a normally vertical orientation to a substantially horizontal orientation so as to avoid interference with a bridge or other structure under which the boat is passing. The antenna is mounted to a rotatable shaft which is held by a control arm. When the antenna is vertical, the control arm is held by a latch. When necessary to move the antenna to a horizontal orientation, a mechanical actuator connected to the control arm and the latch first opens the latch and then moves the arm so as to rotate the shaft and the antenna. An electrical circuit is provided to sequentially actuate multiple antennas and avoid possible contact between adjacent antennas during movement.

12 Claims, 8 Drawing Sheets

BOAT MOUNTED ANTENNA CONTROLLER SYSTEM

RELATED APPLICATION

This application is a Continuation-In-Part of application of Ser. No. 07/987,632 filed Dec. 9, 1992, now abandoned.

FIELD OF THE INVENTION

The present invention relates to antennas for use on board marine vessels and more particularly to controllers adapted to lower and raise these antennas to avoid damage when passing under a bridge or the like.

BACKGROUND OF THE INVENTION

Pleasure marine craft typically carry several long, vertically oriented radio antennas as well as one or more radar antennas. These antennas are used in the upright, or vertical position in order to optimize signal reception. This length of antenna and vertical orientation makes the antenna considerably taller than the boat, and frequently tall enough to interfere when the boat is to pass under a bridge or similar structure. Heretofore, the commonly available correction to avoid a collision requires the boat operator to manually lower the antenna before the bridge and raise the antenna after. A similar situation exists with many fishing boats with respect to fishing poles which are mounted upright.

An improvement in the means to lower and raise the radar type of antenna, which antenna is typically mounted on an overhead arch on the boat, is disclosed in U.S. Pat. No. 4,694,773 to Sparkes et al. for a Remote Control Tilting System For Raising And Lowering Radar And Radio Arch For Boats. The Sparkes et al. patent teaches a tiltable arch which carries the subject antennas. The tilting action is accomplished by means of a powered actuator coupled to the arch.

While the Sparkes et al. patent discloses a useful mechanism, it does present drawbacks which limit its value. One such limitation is that a hydraulic actuator, as described in patent '773, requires a motor, a pump and control valves to operate, and thus is somewhat complex. A second limitation is that the described invention, being hydraulic, is prone to variations in position and motion dependent upon the temperature of the fluid at the time. A third limitation is that the described mechanism is suited specifically for use with antennas mounted on an arch, which is not available in all boats, and is not always appropriate for the antenna desired to be mounted. Longer antennas are not suited for arch mounting since they traditionally require an upper stabilizing support.

Another related invention is disclosed in U.S. Pat. No. 5,140,928 to Frick for a CONTROL SYSTEM FOR OUTRIGGER SPORT FISHING. Frick teaches an apparatus to mechanically manipulate the orientation of an outrigger fishing pole attached to a boat. The apparatus permits movement of the outrigger in angular relation to the longitudinal axis of the keel from horizontal to vertical and from perpendicular to parallel in a horizontal plane.

The Frick patent invention deals with a mechanism intended to advantageously position a fishing pole in two planes of motion not dealing with the situation of passing beneath a bridge, of multiple pole movement or of status indication to guard against damage.

Therefore, it is an objective of the present invention to provide an antenna controller which is operable without the use of hydraulics.

It is an additional objective of the present invention to provide a controller to lower and raise a boat-mounted antenna or fishing rod which will be applicable to radio type, as well as radar type, antennas.

It is a further objective of the present invention to provide a controller which is operable to lower and raise fishing rods mounted to a boat.

It is a still further objective of the present invention to provide an antenna controller which is simple to install and simple to operate.

These and additional objectives will be apparent to those skilled in the art through the disclosure and drawings to follow.

SUMMARY OF THE INVENTION

The invention disclosed herein provides a controller for lowering and raising boat-mounted antennas or fishing rods for safely passing under a bridge or similar structure. The mast antenna or fishing rod, according to the preferred embodiment, is mounted perpendicularly to a horizontally mounted rotatable shaft by means of a mast support tube. The shaft is connected by pivot pins through a control arm to the piston rod of a mechanical linear actuator, the base end of which is pivotally mounted to one end of a pivot arm. The other end of the pivot arm is linked to a tie rod which actuates a latch to engage and disengage the control arm. When the linear actuator operates, the pivot arm first releases the latch and then the control arm rotates the attached antenna downwardly.

A further aspect of the invention is that an electrical circuit is connected through a series of switches so that, when the boat is equipped with multiple antennas mounted to a common surface, the antenna controllers are sequentially activated so as to prevent physical interference of the antennas with one another. The circuit provides individual lights which indicate by different colors and flashing mode sequence when the antenna is up in the up or down position, or is encountering an obstruction to movement.

BRIEF DESCRIPTION OF THE DRAWINGS

FIG. 10A for antenna lowering operations;

FIG. 10B for antenna raising operations; and

FIG. 10C for antenna status light indicators.

DESCRIPTION OF THE INVENTION

Figure 1:
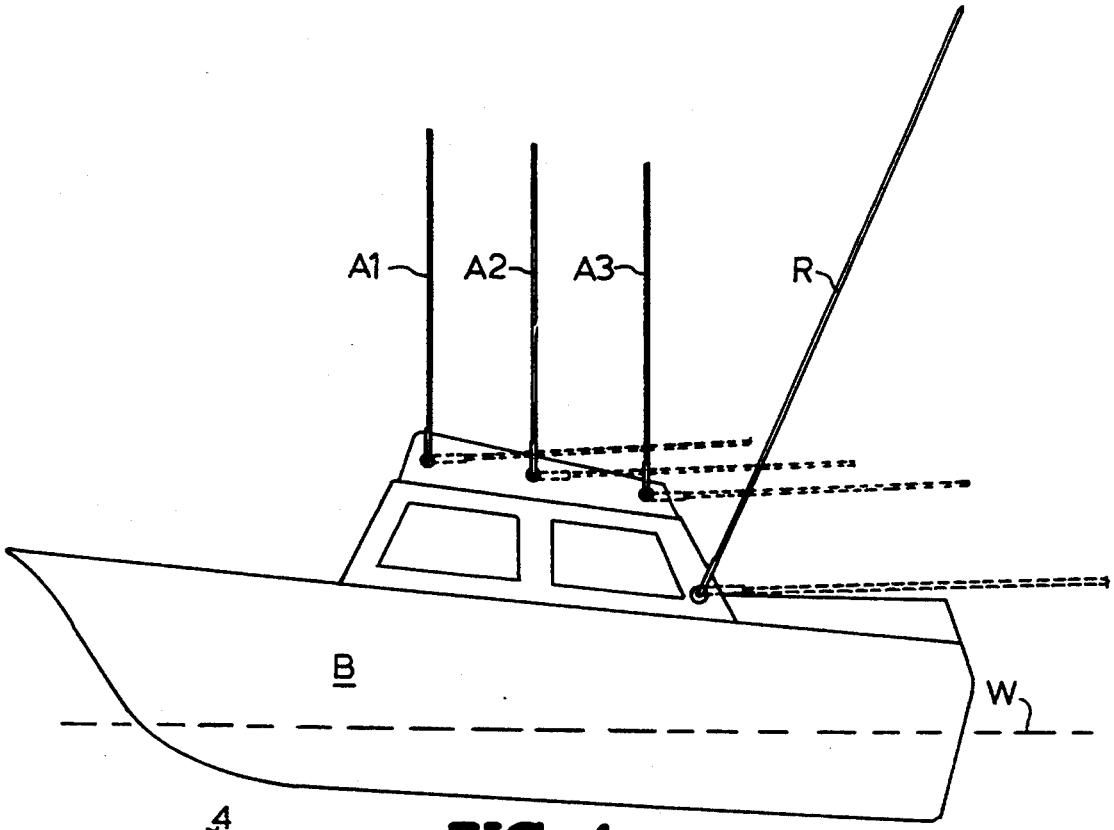
FIG. 1 is a side elevation view of a boat having a plurality of mast antennas and one fishing rod which could interfere with the boat passing under a bridge or similar structure.

As illustrated in FIG. 1, a typical pleasure or fishing boat is equipped with a plurality of tall, vertically oriented antennas A1, A2, A3 which must be lowered to allow the boat to pass freely under a bridge, into a boathouse, or the like. An additional one or more fishing rods R may be set in a vertical or non-vertical position. The present invention provides a controller which affords a means to lower and to raise these mast antennas A1, A2, A3 and fishing rod R by means of a switch in the boat's control module, rather than lowering and raising them by hand. The description which follows is related to antennas, but is similarly applied to other pole devices such as fishing rods. As shown, boat B is floating in the water W and has antennas A1, A2 and A3 in their vertical, or up, orientation in solid lines and horizontal, or down, orientation in dashed lines. Mast antennas A1, A2, A3 are normally positioned in their up position to be parallel to each other and perpendicular to the surface of water W.

Depending upon the wall configuration of the boat B, the antenna controller disclosed herein may be mounted within the enclosure of boat B with an actuating shaft passing through the wall or may be mounted to an exterior wall surface with the addition of a molded protective enclosure. As illustrated in FIG. 1 and described below, the antenna controller is mounted within the enclosure of the boat B with a portion of its shaft, which supports and moves the typical antenna A, protruding through the wall of boat B. In the description to follow, the pole device is designated "antenna A" to symbolically indicate any of the boat's antennas, fishing poles, or the like, and the invention is intended, according to the preferred embodiment, to employ one control mechanism for each such antenna A.

Figure 2:
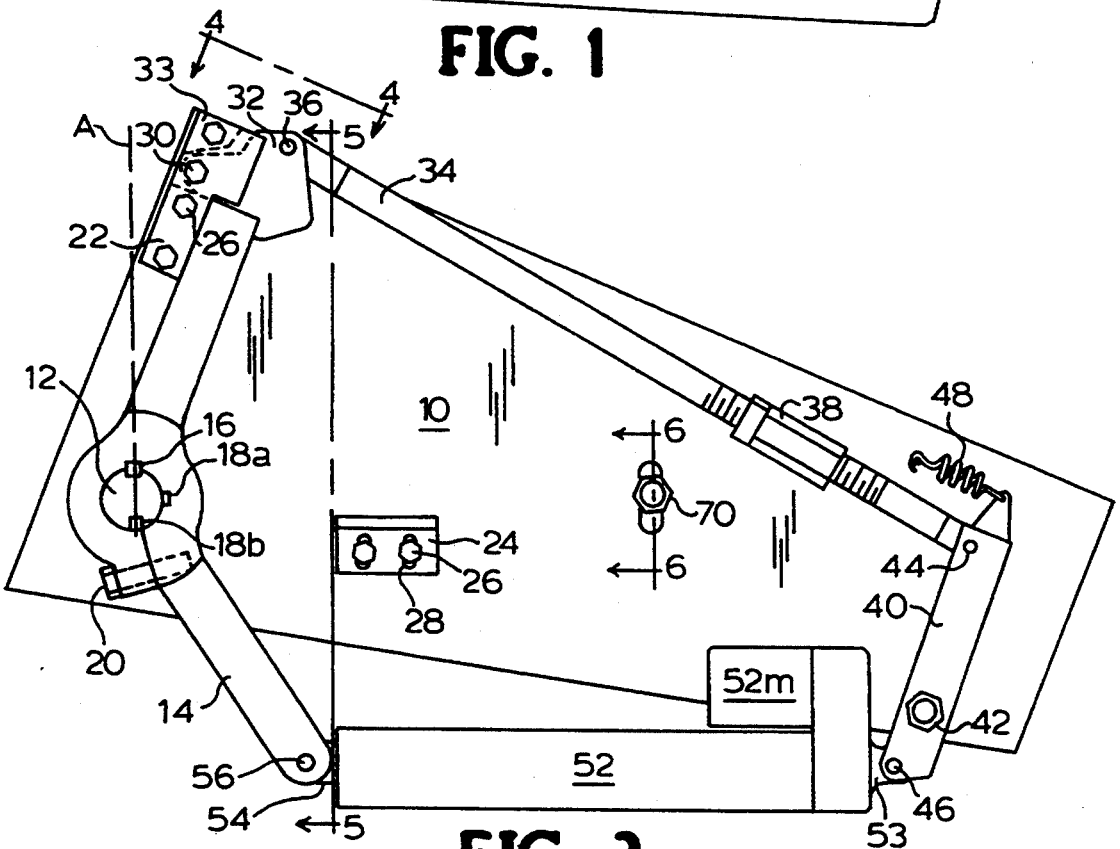
FIG. 2 is a side elevation view of the controller of the invention portrayed in position in which the attached antenna is oriented vertically.
Figure 3:
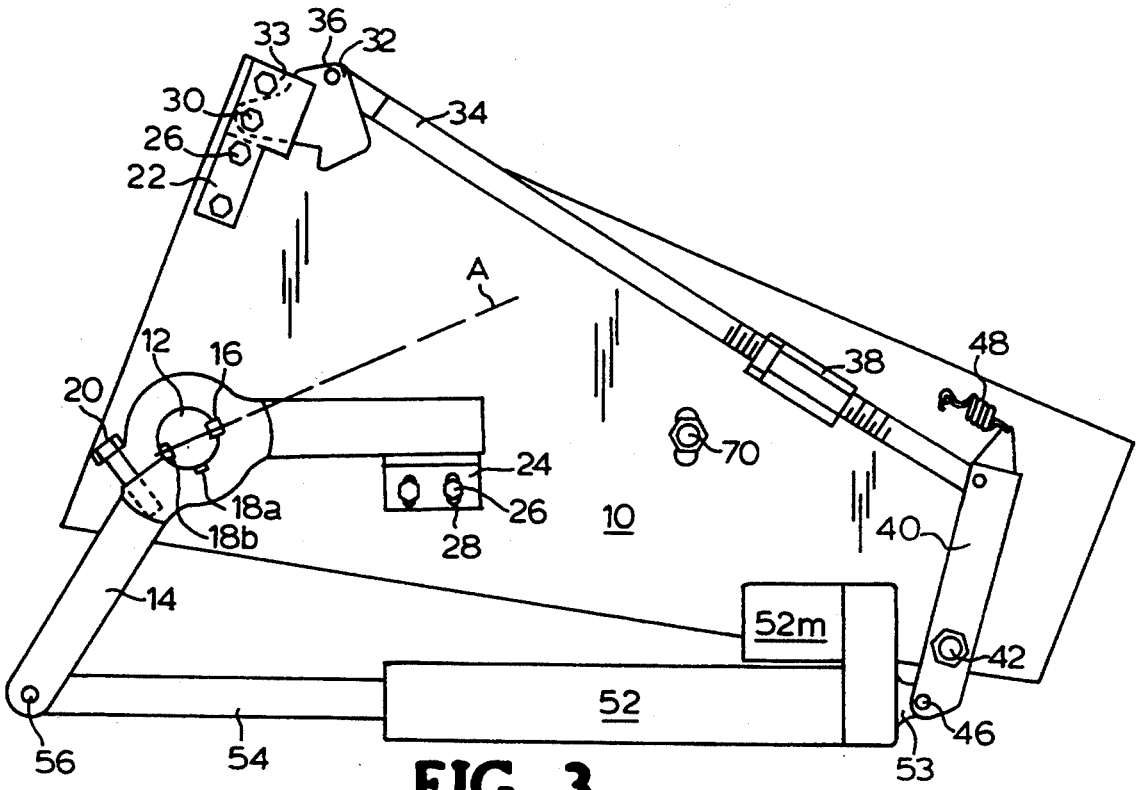
FIG. 3 is a side elevation view of the controller of FIG. 2 shown with the antenna lowered to a near horizontal orientation.

In FIGS. 2 and 3, the pole device, such as an antenna is represented by a dashed line along its projected axis. The antenna controller of the invention is illustrated holding antenna A upright in FIG. 2 and holding antenna A in the lowered position in FIG. 3. Throughout the descriptions, identical numbering is used to designate identical parts.

Referring now to FIG. 2, all components are mounted on and operate in relation to locking plate 10 which is shaped to accommodate the various parts and actions that occur. Shaft 12 is assembled perpendicularly through locking plate 10 and supports antenna A in a manner to be described below. Control arm 14 is securely mounted onto shaft 12 with both key 16, fitted in a first keyway, and clamping bolt 20 in an orientation to allow movement angularly in a plane parallel to locking plate 10. A second keyway **18*a*, 18*b* is provided, offset by 90° from keyway 16, in control arm 14 and shaft 12** to permit mounting the entire mechanism to conform to space availability in a substantially vertical orientation.

Control arm 14 is connected by means of arm pin 56 to the piston rod 54 of linear actuator 52. Control arm 14 is able to rotate from a position in contact with up stop 22 to contact with down stop 24, simultaneously rotating shaft 12 and antenna A. Up stop 22 is secured to locking plate 10 by anchor bolts 26 and extends up to a divided portion which houses pivotable latch 32 and latch stop 33. Latch 32 essentially locks control arm 14 so that antenna A is vertical, and thus relieves possible pressure or strain from being exerted on linear actuator 52 which may occur due to boat movement or wind. Latch 32 is mounted on and rotates about pivot bolt 30 and is driven by a first end of tie rod 34. Tie rod 34 is moved in a substantially straight line from a position in which latch 32 engages control arm 14 to one in which latch 32 is free of control arm 14. The second end of tie rod 34 is connected to rotatable pivot arm 40 which is biased to a latch-released position by extension spring 48. The length of tie rod 34, and therefore the position of latch 32, may be adjusted by adjusting nut and lock nut 38, which rod and nuts are threaded to operate as a turnbuckle. Pivot arm 40 is moved around pivot screw 42 by linear actuator 52 to which it is pivotally connected at base connector 53 by pin 46 at a lower end, and by pin 44 to tie rod 34 at an upper end.

The operation of the antenna controller begins with antenna A in the up position as shown in FIG. 2, and linear actuator motor **52*m* being electrically energized. As linear actuator 52 begins to extend piston rod 54, control arm 14 is held in engagement by latch 32 and cannot move. Pivot arm 40 is therefore pushed counterclockwise by the action of linear actuator 52, which moves tie rod 34 and rotates latch 32 out of engagement with control arm 14. With control arm 14 now free of latch 32, and the piston rod 54 of linear actuator 52 continuing to extend, control arm 14 is rotated clockwise to lower antenna A until control arm 14 contacts down stop 24** at a location relating to antenna A being substantially horizontal. The resultant positions of the various components of the invention when antenna A is down are illustrated in FIG. 3.

In the preferred embodiment, linear actuator 52 is Electrak® model 9210-103-224, supplied by Warner Electric Brake & Clutch Co. of South Beloit, Ill. This linear actuator operates electromechanically. According to the requirements of the installation, this linear actuator 52 can be obtained in a variety of voltages and stroke lengths. This model linear actuator is equipped with a potentiometer feedback device for position sensing.

As shown in FIGS. 2 and 3, down stop 24 is mounted to locking plate 10 with slotted holes 28 for anchor bolts 26 to permit adjustment.

Figure 4:
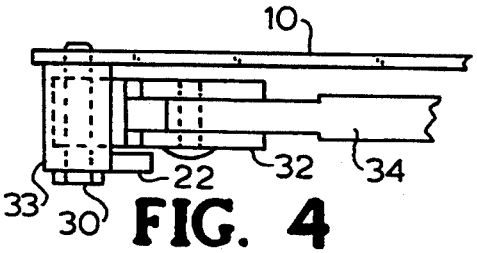
FIG. 4 is an oblique plan view of a portion of the controller of FIG. 2 taken in the direction of line 4—4.

A plan view of the latch 32 mechanism is shown in FIG. 4 taken in the direction of line 4—4 of FIG. 2. Latch 32 is pivotally mounted by pivot bolt 30 to reside within a channel in up stop 22. Latch stop 33 is located behind and above latch 32 to permit enough rotational movement thereof to disengage latch 32 from control arm 14, thereafter transferring the force of linear actuator 52 to move control arm 14 into its antenna down position.

Turning now to FIG. 3, the antenna controller of the invention is seen in the antenna A down position, control arm 14 being down and latch 32 disengaged. As linear actuator 52 attempts to retract piston rod 54, the spring 48 retains pivot arm 40 in the position in which latch 32 is held open as control arm 14 is pulled counterclockwise. When control arm 14 contacts and is stopped by up stop 22, antenna A is in the substantially vertical position. The drive force of linear actuator 52 is then transferred to pivot arm 40 which overcomes spring 48 and moves clockwise to pull latch 32, by means of tie rod 34, into engagement with and capturing control arm 14.

Figure 6:
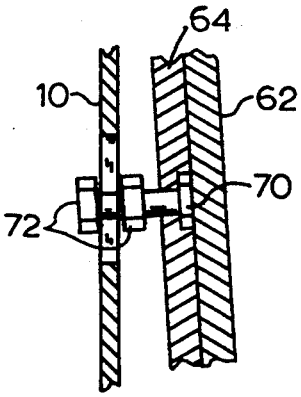
FIG. 6 is a sectional front view taken in the direction of line 6—6 of FIG. 2.
Figure 5:
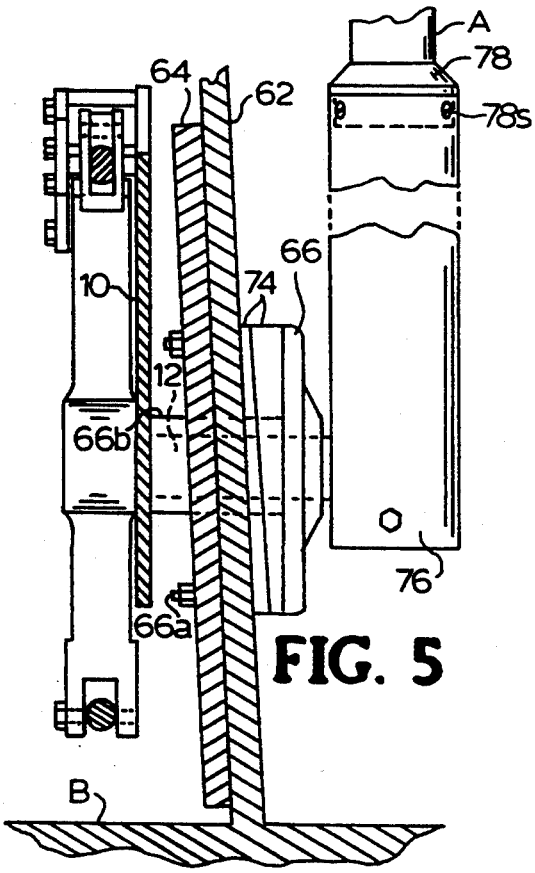
FIG. 5 is a sectional front view taken in the direction of line 5—5 of FIG. 2.

Having described the components and movement of the antenna controller above, attention is brought to FIG. 5 to disclose the means of attachment to the boat B. Boats are generally built having their exterior walls above the main deck angled inwardly toward the top. For mounting the antenna controller of the invention to such boats, a pair of complimentarily angled alignment blocks 74 is positioned adjacent wall 62 and oriented to compensate for the wall angle so as to result in a substantially vertical surface to which mounting flange 66 is mounted. Mounting studs 66*a* protrude from mounting flange 66 through alignment blocks 74, wall 62 and backing plate 64 to be secured by nuts. A tube 66*b* integrally formed with and extending from the center portion of mounting flange 66 through wall 62 and backing plate 64 terminates against locking plate 10 within boat B. Tube 66*b*, which has an internal bushing (not shown) to freely accept shaft 12, is substantially perpendicular to locking plate 10. As illustrated in FIG. 6, a mounting bolt 70, having the head thereof recessed into a remote surface of backing plate 64, passes through backing plate 64 and is anchored by a pair of lock nuts 72. Mounting bolt 70 is preferably located in the central area of locking plate 10. The outboard end of shaft 12 is attached to support tube 76 as will be described below.

Figure 7:
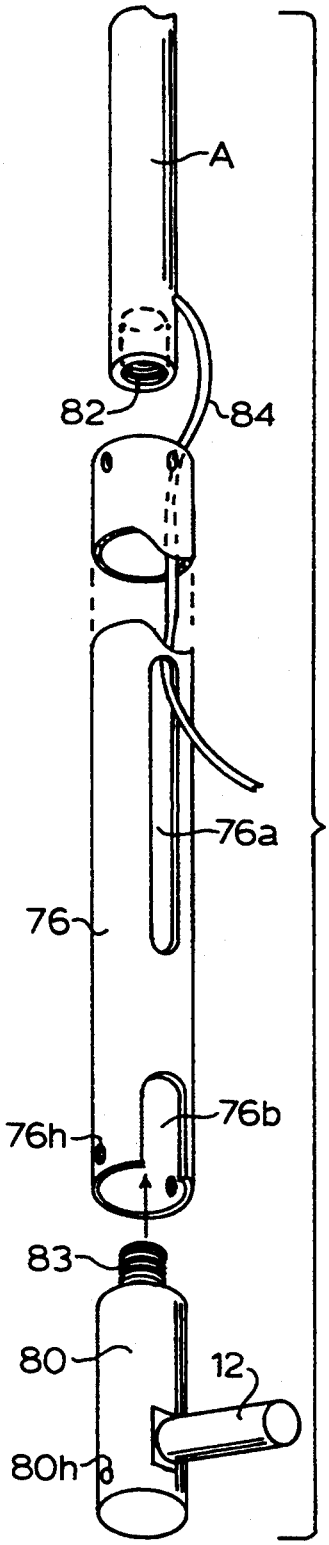
FIG. 7 is an exploded perspective illustration of an antenna and the antenna support tube of the invention.

Shaft 12 is preferably welded into a transverse hole 80*a* in antenna base 80 (see FIG. 7). Shaft 12 is assembled through mounting flange 66 and tube 66*b* to extend to the interior of locking plate 10. Control arm 14 is next clamped to the inboard end of shaft 12. Antenna A, having an internally threaded bottom portion 82, is inserted through a conical tube cap 78, support tube 76 and threaded onto the external thread 83 at the free end of antenna base 80. Antenna wire 84 is threaded out of tube 76 through wire slot 76*a*. The support tube 76 is then placed over the antenna base 80 and held there by a transverse screw through matching holes 76*h* and 80*h*. Tube cap 78 (FIG. 5) is then secured in place in the upper end of support tube 76 by set screws 78*s*. Support tube 76 acts to stabilize the position of pole devices, particularly those of longer length.

Figure 10A:
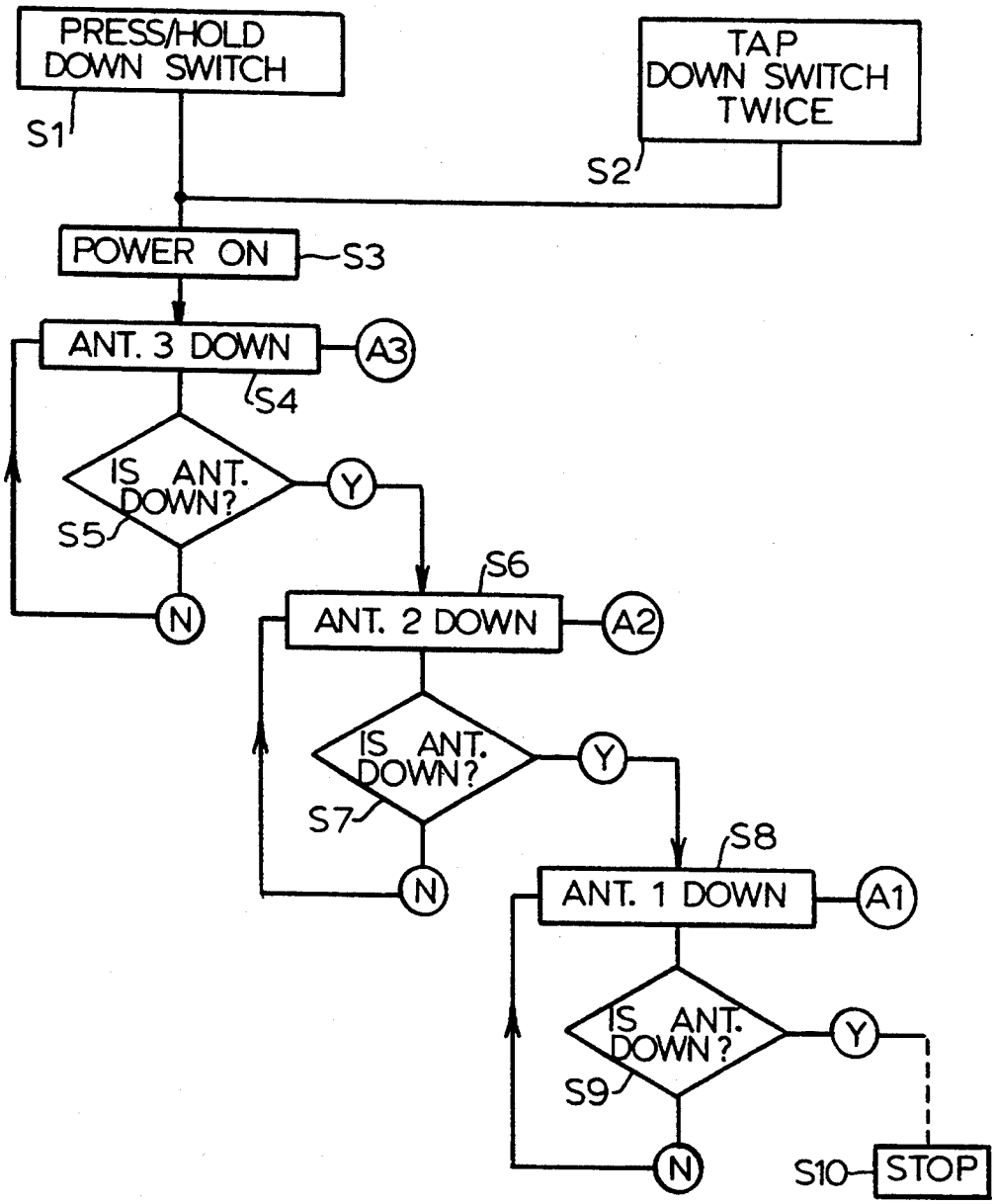
FIGS. 10A–10C are a series of schematic flow charts depicting the series of operations performed by the antenna controller of the invention in three sections.
Figure 10B:
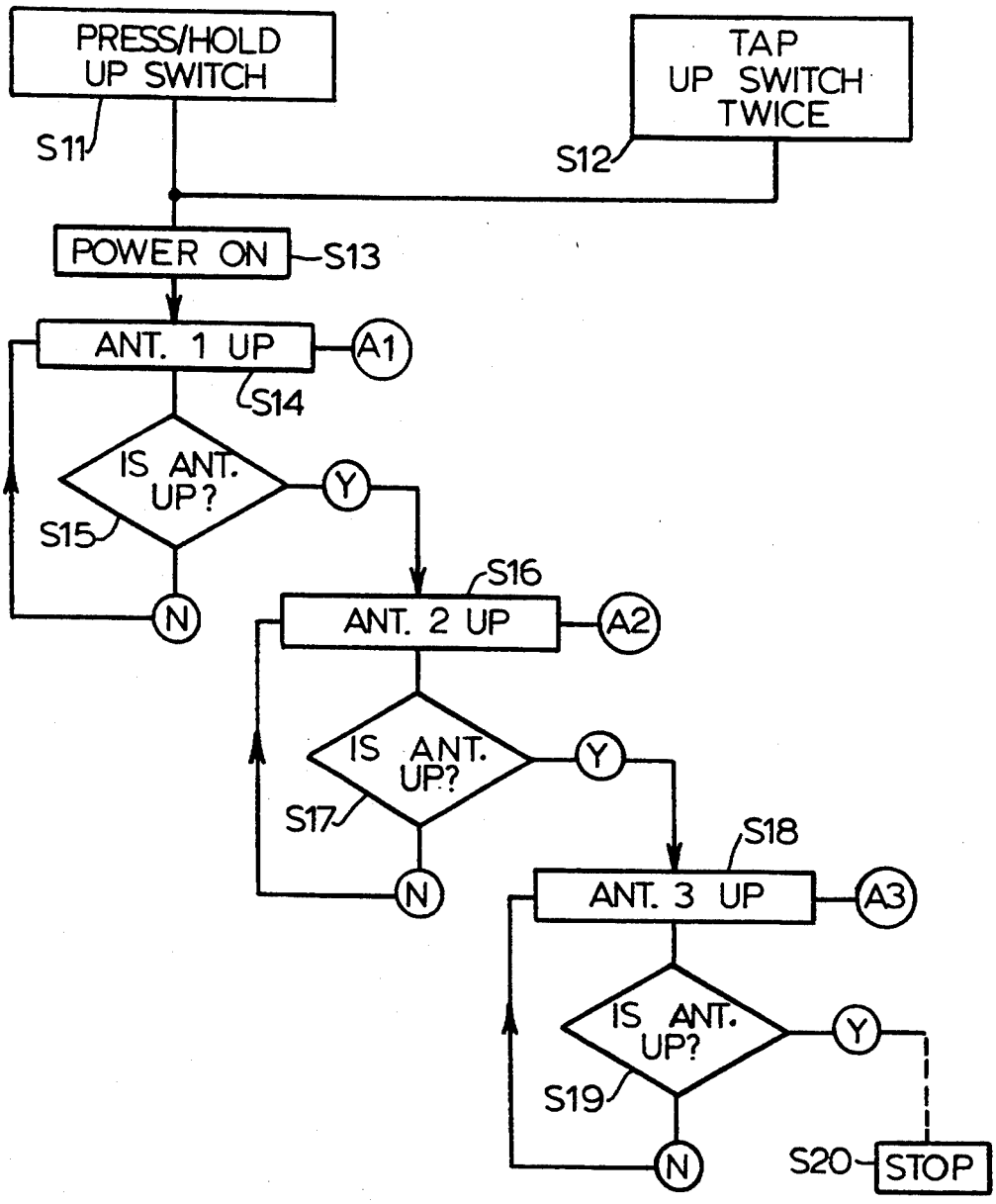
Figure 10C:
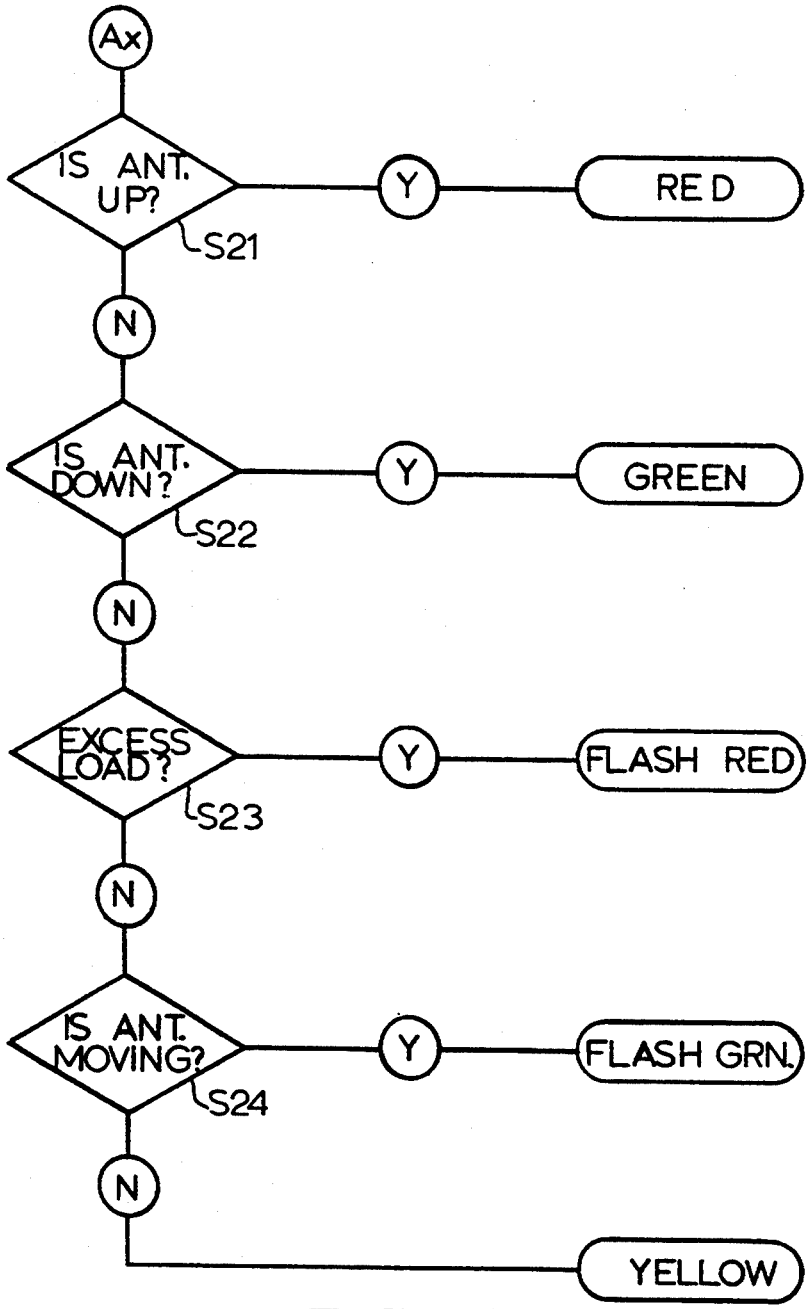

The basic functions of the operation are depicted in a series of flow chart diagrams, FIGS. 10A, 10B and 10C. FIG. 10A follows the apparatus logic control in lowering a series of antennas incorporating the antenna device as described above through sequential steps S1 through S10. The process is initiated in step S1 wherein an electrical momentary contact switch is depressed by the operator and held down; release of the switch during the cycle will interrupt the process. The lowering sequence may be also initiated by tapping the momentary contact switch twice quickly, as per step S2, in which case it is not necessary to continue holding the switch.

The system power in step S3 is activated by either step S1 or S2 as per above, which is connected directly to the actuator for lowering rearmost antenna 3 in step S4. As antenna 3 is electrically activated, the electrical signal is connected to contact A3 which drives a subsystem for indicator light activation, as will be described below (see FIG. 10C). A logic sequence S5 is activated to determine repeatedly if antenna 3 has reached the end of travel in the down position: if the logic circuit senses negative N, the downward travel is continued: if the logic circuit gets a positive response Y, power is diverted to the next antenna actuator in step S6.

Steps S6, S7 follow the same sequence of operations as steps S4 and S5 above, terminating when antenna 2 is in its down position by diverting power to the antenna 1 actuator. Steps S8 and S9 are run similarly for antenna 1 and the power is switched to the next antenna in sequence. The series of steps described may be repeated for as many antennas as are wired into the microprocessor described above. At the end of the travel downward of the last antenna in the series, a positive response Y deactivates the sequence in step S10, STOP.

FIG. 10B follows a similar series of steps to raise antennas as was done in FIG. 10A for the lowering operation in reverse sequence. Step S11 or S12 activates the process to energize antenna 1 in steps S13, S14. Antenna 1 moves up as step S15 monitors progress and continues movement up until a positive reply Y causes power to be switched to antenna 2 in step S16. The same process continues through step S20 to stop after the last of the antennas reaches the up position.

The logic status signalling circuit depicted in FIG. 10C is powered as long as the main power is on. A number of sub-systems depicted typically in FIG. 10C are each connected respectively to each of the antenna controllers A1, A2 and A3 in FIGS. 10A and 10B. A feedback potentiometer (not shown) contained within each antenna actuator is probed to obtain a resistance reading corresponding to the position of the actuator. Step S21 determines if the antenna being probed is in the UP position; if a positive response Y, a red signal from the dual polarity LED is generated; if a negative response N is obtained, next step S22 is employed to determine if the antenna is in the DOWN position. The same logic follows and generates a green signal if the antenna is down. Otherwise, step S23 is checked to determine if the antenna is meeting excess physical resistance and thus exhibiting an excess load, which results in a flashing red LED. If an excess load is not determined, step S24 is employed to determine if the antenna is moving, resulting in either a flashing green LED or a yellow to indicate a manual, mid-travel stop. The set of status lights are always in operation for each antenna and show position, movement or problems for each antenna through the operation.

Figure 8:
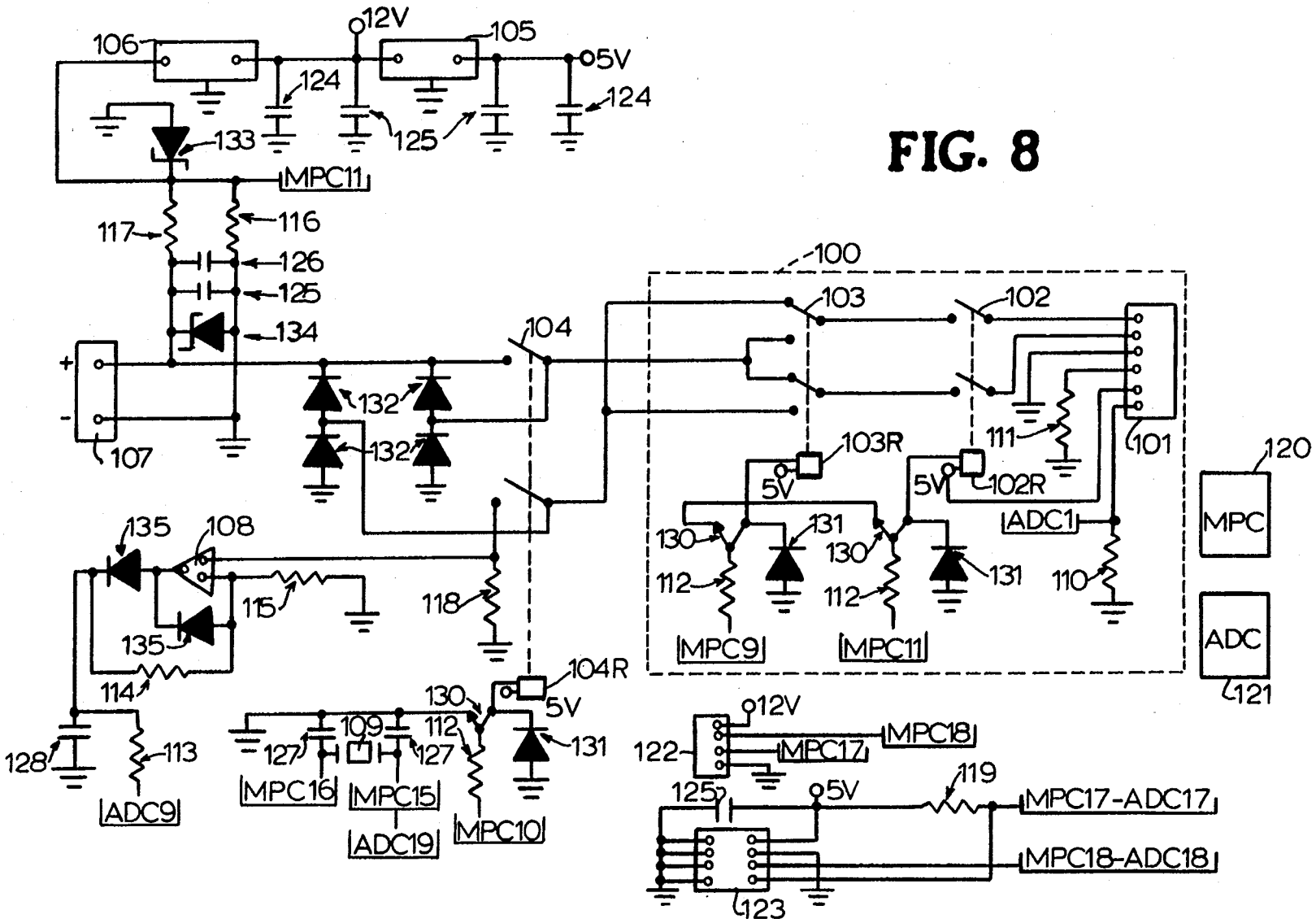
FIG. 8 is a schematic electrical diagram of the main operating circuit of the invention as relating to an installation of six antennas.
Figure 9:
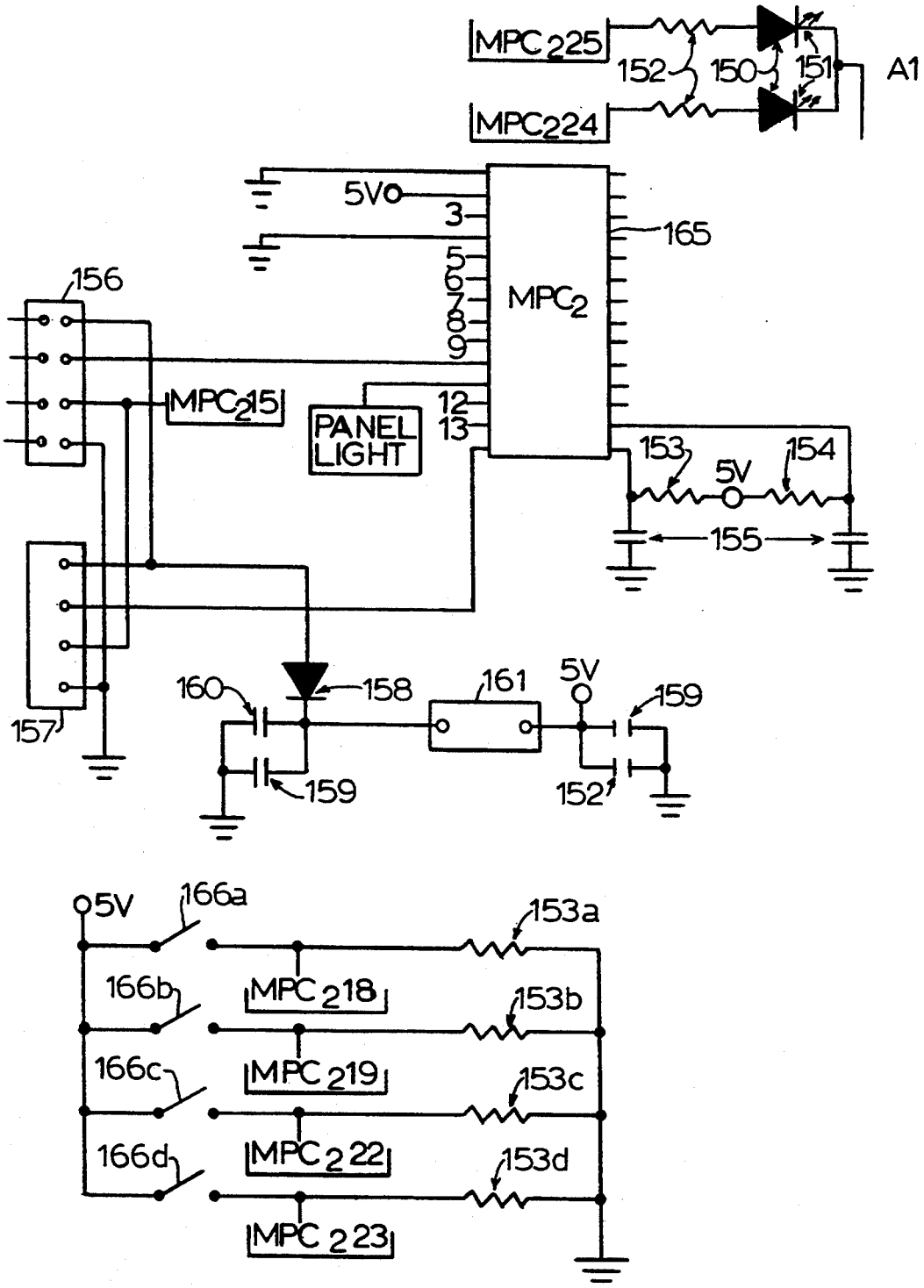
FIG. 9 is a schematic electrical diagram of a remote control station circuit of the invention.

The electrical control circuit for the antenna controller system of the invention is divided into two segments. Operation of the electrical circuitry follows the flow chart sequences disclosed above by means of programmable microprocessor chips and memory boards incorporated in the electronic apparatus. FIG. 8 depicts the main controller board of the circuit. FIG. 9 depicts the remote operating panel for the system.

In the main operating circuit illustrated in FIG. 8, MicroProcessor Chip 120 and analog/digital converter 121 are connected through a plurality of terminal pins to various portions of the circuit as shown and described (e.g. a notation in the FIG. 8 circuit diagram of "MPC 18" indicates pin number 18 of MPC, MicroProcessor Chip 120). MicroProcessor Chip 120 is programmed with the logic steps schematically illustrated in FIG. 10C. Identification of each of the components incorporated in FIGS. 8 and 9 appear in the listing below. Certain of the components are built into the circuit in several locations and carry the same number identification.

Section 100 of FIG. 8 is typical of an individual antenna actuator connection circuit section. In a system according to the invention having 6 antennas, 6 wired sections duplicating section 100 would be employed and connected to individual terminal pins of MPC 120 and ADC 121. Connective plug 101 powers and controls the first of a series of antenna actuators, each of which is connected to a different set of terminal pins of MPC 120 and ADC 121 to perform similar tasks in sequence. In application, the circuit of FIG. 8 has a number of sections similar to section 100 equal to the number of antenna actuators controlled. For clarity and simplicity, connections are indicated by MPC or ADC numbers and ground standard symbols at the wire or component location. While each section 100 in the total circuit contains a double pole-single throw switch as seen as switch 102, the output terminals of each sequential such switch are connected identically to the input terminals 98, 99 of the solitary double pole-double throw switch 103.

As will be understood from the circuit diagram of FIG. 8, input DC power is connected at DC input plug 107. Voltage transformation may be done to change to the appropriate voltage needed to drive the system, mainly 5 volts DC. The several points at which a 5 volt DC connection is made are indicated by 5 V in a circle. Connection of one or more remote control modules (see FIG. 9) is made to the main circuit at connector plug 122, which in turn conveys power to MPC through terminals MPC 17 and 18.

The electrical circuit of the remote control module is illustrated schematically in FIG. 9 with the same simplifying drawing system as above discussed. The remote module includes a second microprocessor MPC2, which has a series of connective pins to which various components of the initiating switch section 140, control section 142 and status light section 144 are each connected. If a single remote control module is used in a boat installation, four pin output plug 156 is connected to connector plug 122 of FIG. 8. In installations where additional remote control modules are required, e.g. boats having a pilot cabin and a flying bridge, output plug 156 of one module is connected to tandem plug 157 of a second module. With this connection, multiple tandem modules may be connected and each used as the master control for lowering or raising antennas as needed.

The standard components employed in the preferred embodiment are according to the listing below and are identified according to standard trade listing numbers.

| PART NUMBER | IDENTIFICATION NUMBER | DESCRIPTION |
|---|---|---|
| 101 | | Antenna Actuator Plug |
| 102 | | Antenna Switch - DP/ST |
| 103 | | Antenna Relay - DP/DT |
| 104 | | Power Relay - DP/DT |
| 105 | LM7805 | Voltage Regulator |
| 106 | 7808/TO3 | Voltage Regulator |
| 107 | | Power Input Plug |
| 108 | 358 | Dual Operational Amplifier |
| 109 | 27P | General Purpose Crystal |
| 110 | 47K ohm | Resistor |
| 111 | 1K5 ohm | Resistor |
| 112 | 3K3 ohm | Resistor |
| 113 | 100 ohm | Resistor |
| 114 | 4K7 ohm | Resistor |
| 115 | 0.1 ohm | Resistor |
| 116 | 1k5 ohm | Resistor |

-continued

| PART NUMBER | IDENTIFICATION NUMBER | DESCRIPTION |
|---|---|---|
| 117 | 10K ohm | Resistor |
| 118 | 10K ohm | Resistor |
| 119 | 10 ohm | Resistor |
| 120 | PIC1656 | Microprocessor Chip |
| 121 | ADC0811 | Analog/Digital Converter |
| 122 | | Remote Module Socket |
| 123 | 24CO1 | Non-Volatile Memory |
| 124 | 10 μf | Capacitor |
| 125 | 104 μf | Capacitor |
| 126 | 100 μf | Capacitor |
| 127 | 27 pf | Capacitor |
| 128 | 47 μf | Capacitor |
| 130 | 2N3904 | Transistor |
| 131 | 1N4148 | Diode |
| 132 | 1N4005 | Diode |
| 133 | 5.1 V | Zenner Diode |
| 134 | 5Kp3O | Zenner Diode |
| 135 | 1N914 | Diode |
| 150 | 1N4148 | Diode |
| 151 | | LED |
| 152 | 47K ohm | Resistor |
| 153 | 10K ohm | Resistor |
| 154 | 0.1 ohm | Resistor |
| 155 | 104 μf | Capacitor |
| 156 | | Plug |
| 157 | | Plug |
| 158 | 1N914 | Diode |
| 159 | 10 μf | Capacitor |
| 160 | 100 μf | Capacitor |
| 161 | LM7805 | Voltage Regulator |
| 165 | PIC16C5X | Microprocessor Chip |
| 166a | | Antenna UP Switch - SP/ST |
| 166b | | Antenna DOWN Switch - SP/ST |
| 166c | | Antenna Status Switch - SP/ST |
| 166d | | Panel Light Switch - SP/ST |

The installation of the antenna controller system of the invention involves connecting the required number of antenna actuators to an equal number of antenna actuator plugs 101 (FIG. 8), connecting remote module plug 156 (FIG. 9) to remote module socket 122 (FIG. 8) and connecting the output plug 156 of any additional remote modules to the tandem socket 157 of the primary remote module.

To operate the system, initially antenna status switch *166c* is activated. If needed, panel light switch *166d* is closed. When one desires to lower all antennas connected to the antenna controller system of the invention, antenna DOWN switch *166b* is either held in closed position or is tapped twice within 1.5 seconds. The system is activated in automatic mode to operate according to the logic flow chart disclosed above. When one desires to operate manually, the antenna DOWN switch *166b* is held continuously; when released, antenna motion stops. The same series of control steps are employed for raising the antennas in the system, in which case the sequence is reversed, by touching antenna UP switch *166a*. Equivalent response is accomplished from any remote module connected to the system as described.

During non-action and action times, status LED indicators 151 generate and transmit a signal for each antenna according to the pattern schematically indicated in FIG. 10C. In this way the operator is able to quickly determine the position and condition of each of the antennas and decide a corrective action needed for various possible problems.

The invention is disclosed herein in terms of a preferred embodiment and, as such, variations are considered to be within the scope and principles which are to be construed according to the claims below.

What is claimed is:

1. A controller for moving a boat mounted pole device through a selected angle, comprising:

(a) a shaft being rotatably mounted to a boat so as to be rotatable through a selected angle;

(b) a shaft rotating member attached to said shaft so that movement of said shaft rotating member causes said shaft to rotate;

(c) latching means adapted to move between a first latch position in which said latching means securely holds said shaft rotating member and a second latch position in which said latching means releases said shaft rotating member;

(d) linearly operative actuating means pivotably connected on a first end thereof to said latching means and on a second end thereof to said shaft rotating member and operative (i) in a first mode to cause said latching means to pivot from said first to said second latch position and to then cause said shaft rotating member to rotate from a first shaft position to a second shaft position, said first and second shaft positions being within said selected angle;

(ii) in a second mode to cause said shaft rotating member to rotate said shaft from said second shaft position to said first shaft position and to then cause said latching means to pivot from said second to said first latch position; and (e) means to rigidly attach a pole device substantially perpendicular to said shaft.

2. The controller for moving a boat mounted pole device as claimed in claim 1 in which said shaft is mounted to said boat in a substantially horizontal orientation.

3. The controller for moving a boat mounted pole device as claimed in claim 1, wherein said actuating means comprises an elctromechanically operative linear actuator.

4. A controller for moving a boat mounted pole device through a selected angle, comprising:

(a) pole device support means mounted rotatably to a boat and adapted to move a pole device secured thereto between a substantially vertical orientation and a substantially horizontal orientation;

(b) latch means mounted and adapted to secure said pole device support means in a position relating to said substantially vertical orientation of said pole device and to release said pole device support means when so actuated; and (c) linearly operative actuating means mechanically connected and operative to move said latch means so as to release said pole device support means and to then rotate said pole device support means so as to move said pole device from said substantially vertical position to said substantially horizontal position.

5. The controller for moving a boat mounted pole device as claimed in claim 4 in which said pole device support means is so positioned to move said pole device in a substantially vertical plane.

6. The controller for moving a boat mounted pole device as claimed in claim 4 wherein said actuating means comprises an elctromechanically operative linear actuator.

7. A controller system for moving a plurality of boat mounted pole devices through a selected angle, comprising:

(a) a plurality of pole device controllers each having;

(1) means to rotatably mount said pole device to a boat to enable said pole device to be raised or lowered;

(2) means to rotate said rotatably mounted means to raise or lower said pole device;

(b) an electrical circuit configured to sequentially activate each of said means to rotate said rotatably mounted means to cause each said pole device to move through said selected angle in sequence; and (c) means to deactivate said electrical circuit when a final of said plurality of pole devices has been rotated through said selected angle.

8. A controller system for moving a plurality of boat mounted pole devices through a selected angle, comprising:

(a) a plurality of pole device controllers each having;

(1) means to rotatably mount said pole device to a boat to enable said pole device to be raised or lowered;

(2) means to rotate said rotatably mounted means to raise or lower said pole device; and (b) a programmable microprocessor chip programmed to activate a second means to rotate said rotatably mounted means capable to rotate said pole device upon the completion of operation of a first means to rotate said rotatably mounted means.

9. The controller system as claimed in claim 8, wherein said controller system further comprises a main circuit and a remote module adapted to generate and transmit a signal indicative of a lowering or raising operation for each said pole device.

10. A controller system for moving a plurality of boat mounted pole devices each through a selected angle, said system comprising:

(a) a plurality of pole device controllers, comprising;

(1) pole device support means mounted rotatably to a boat and adapted to move a pole device secured thereto between a substantially vertical orientation and a substantially horizontal orientation;

(2) latch means mounted and adapted to secure said pole device support means in a position relating to said substantially vertical orientation of said pole device and to release said pole device support means when so actuated; and (3) linearly operative actuating means mechanically connected and operative to move said latch means so as to release said pole device support means and to then rotate said pole device support means so as to move said pole device from said substantially vertical position to said substantially horizontal position; and (b) an electrical circuit configured to sequentially activate each of said plurality of pole device controllers in response to an input signal.

11. A pole device controller system as claimed in claim 10, further comprising a series of status indicators capable of generating a signal which represents position and condition of each pole device in said system.

12. A pole device controller system as claimed in claim 11, wherein said indicators are light devices able to generate multiple color indications.

* * * * *